US006239342B1

(12) United States Patent
Chang

(10) Patent No.: US 6,239,342 B1
(45) Date of Patent: May 29, 2001

(54) STRETCHING STRUCTURE OF A DRUM FOOT PEDAL

(75) Inventor: Jung-Pin Chang, Taipei (TW)

(73) Assignee: New Sound Enterprise & Musical Instrument Mfg. Co., Ltd., Taichung Hsien (TW)

( * ) Notice: Subject to any disclaimer, the term of this patent is extended or adjusted under 35 U.S.C. 154(b) by 0 days.

(21) Appl. No.: 09/492,671

(22) Filed: Jan. 28, 2000

(51) Int. Cl.[7] ..... G10D 13/02

(52) U.S. Cl. ..... 84/422.1; 84/422.2; 84/422.3; 84/421

(58) Field of Search ..... 84/422.1, 422.2, 84/422.3, 421

(56) References Cited

U.S. PATENT DOCUMENTS 5,365,824 * 11/1994 Hoshino ..... 84/422.1
5,798,472 * 8/1998 Shigenago ..... 84/422.1
6,093,878 * 7/2000 Hoshino ..... 84/421

* cited by examiner

*Primary Examiner*—Shih-Yung Hsieh
(74) *Attorney, Agent, or Firm*—A & J

(57) ABSTRACT

In a drum foot pedal comprising a base having two upwardly extending arms provided two sleeves at the upper ends thereof, a pedal having an end pivotally mounted on the pedal, a hexagonal axle, two bearings fitted in the sleeves, a stick having an end fixedly mounted on the hexagonal axle, a block member provided with a chain which extends downwardly to engage with another end of the pedal, and a stretching mechanism mounted between an end of the hexagonal axle and a flange of one of the arms, the improvement wherein the stretching mechanism comprises a connector fixedly mounted on the hexagonal axle by a pin, a spring having an upper end connected with the connector, a screw rod having an upper end connected with a lower end of the spring, a nut threadedly engaged with an intermediate portion of the screw rod, and a locking nut threadedly engaged with a lower portion of the screw rod, the flange being formed at the bottom with two cross inclined surfaces and a slot in which is fitted a positioning plate having a semi-circular hole, the screw rod having an intermediate portion formed with a semi-circular cross section configured to engage with the semi-circular hole and the locking nut having two cross inclined surfaces configured to engage with the two cross inclined surfaces of the flange.

1 Claim, 5 Drawing Sheets

STRETCHING STRUCTURE OF A DRUM FOOT PEDAL

BACKGROUND OF THE INVENTION

1. Field of the Invention

This invention is related to an improvement in the stretching structure of a drum foot pedal and in particular to one which can be accurately controlled to apply force to beat a drum.

2. Description of the Prior Art

Referring to FIGS. 1, 2, 3A and 3B, the conventional drum foot pedal includes a base 1, a pedal member 2, a chain 51 connecting the pedal member 2 to a hexagonal axle 3, a pair of bearings 4, a pair of sleeves 12, a stick 5 and a stretching mechanism 6. The stretching mechanism 6 includes a connector 62 which is fixedly mounted on the hexagonal axle 3 by a pin 61, a spring 63 connected at the upper end with the connector 62, a screw rod 64 connected with the lower end of the spring 63, and a locking nut 66 engaged with the lower portion of the screw rod 64. However, when the pedal 2 is depressed to beat a drum, the screw rod 64 will be pulled by the spring 63 and will be slightly turned clockwise or counterclockwise thereby loosening the nut 66 and therefore forming a clearance between the nut 66 and the flange 113. Accordingly, it is impossible to control the force applied to the stick 5. In addition, there will be a delay in moving the stick 5. Furthermore, the spring 63 will be slightly distorted during the operation of the drum foot pedal hence making the drum foot pedal unable to be operated smoothly.

SUMMARY OF THE INVENTION

This invention is related to an improvement in the stretching structure of a drum foot pedal.

According to a preferred embodiment of the present invention, the drum foot pedal includes a base having two upwardly extending arms provided two sleeves at the upper ends thereof, a pedal having an end pivotally mounted on the pedal, a hexagonal axle, two bearings fitted in the sleeves, a stick having an end fixedly mounted on the hexagonal axle, a block member provided with a chain which extends downwardly to engage with another end of the pedal, and a stretching mechanism mounted between an end of the hexagonal axle and a flange of one of the arms, the improvement wherein the stretching mechanism comprises a connector fixedly mounted on the hexagonal axle by a pin, a spring having an upper end connected with the connector, a screw rod having an upper end connected with a lower end of the spring, a nut threadedly engaged with an intermediate portion of the screw rod, and a locking nut threadedly engaged with a lower portion of the screw rod, the flange being formed at the bottom with two cross inclined surfaces and a slot in which is fitted a positioning plate having a semi-circular hole, the screw rod having an intermediate portion formed with a semi-circular cross section configured to engage with the semi-circular hole and having two cross inclined surfaces configured to engage with the two cross inclined surfaces of the flange.

It is the primary object of the present invention to provide an improvement in the structure of a drum foot pedal which can be accurately controlled to the force applied to the drum.

It is another object of the present invention to provide an improvement in the structure of a drum foot pedal wherein the spring will not be distorted in operation thereby ensuring the smooth operation of the drum foot pedal.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
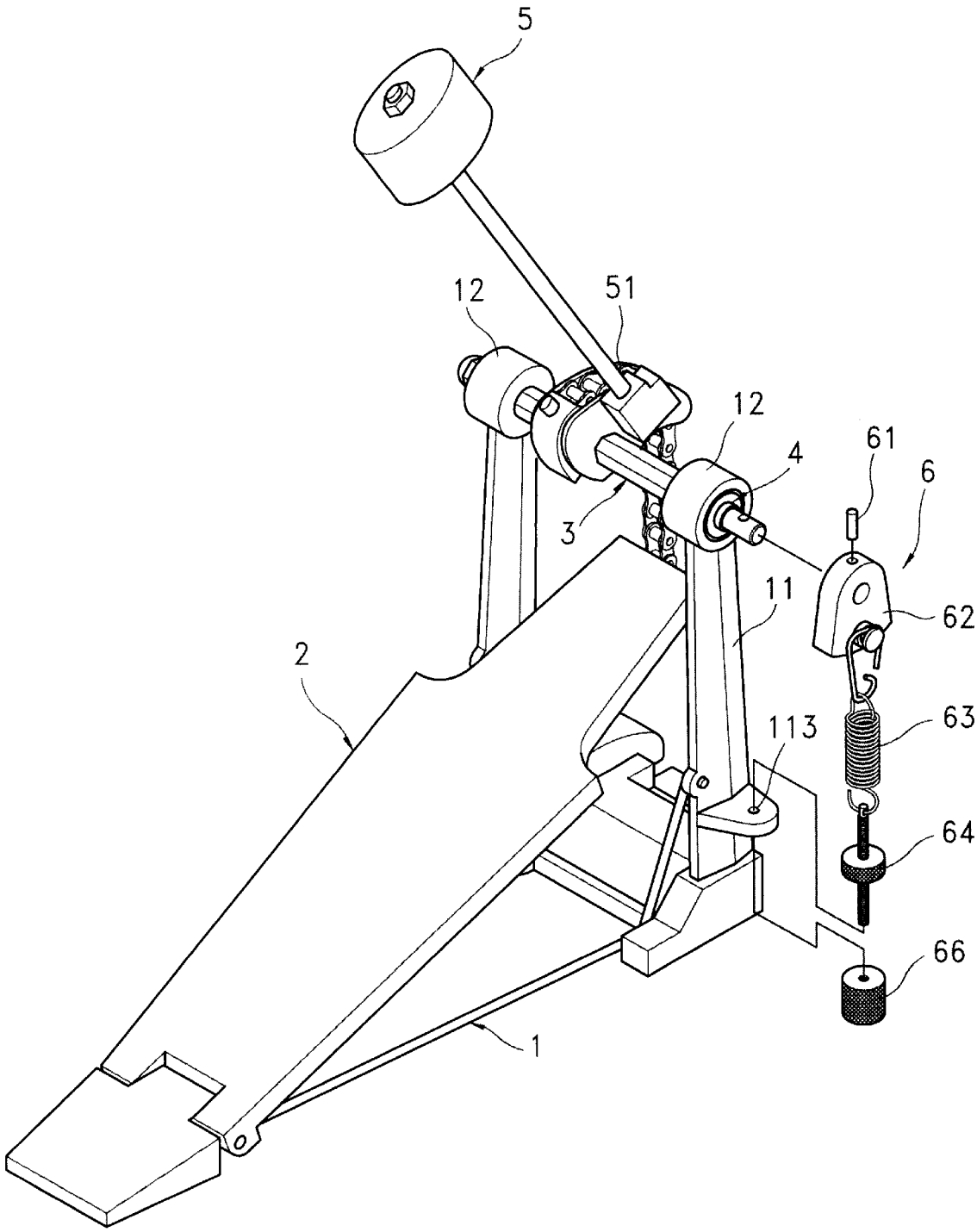
PRIOR ART FIG. 1
FIG. 1 is a perspective view of a conventional drum foot pedal.
Figure 2:
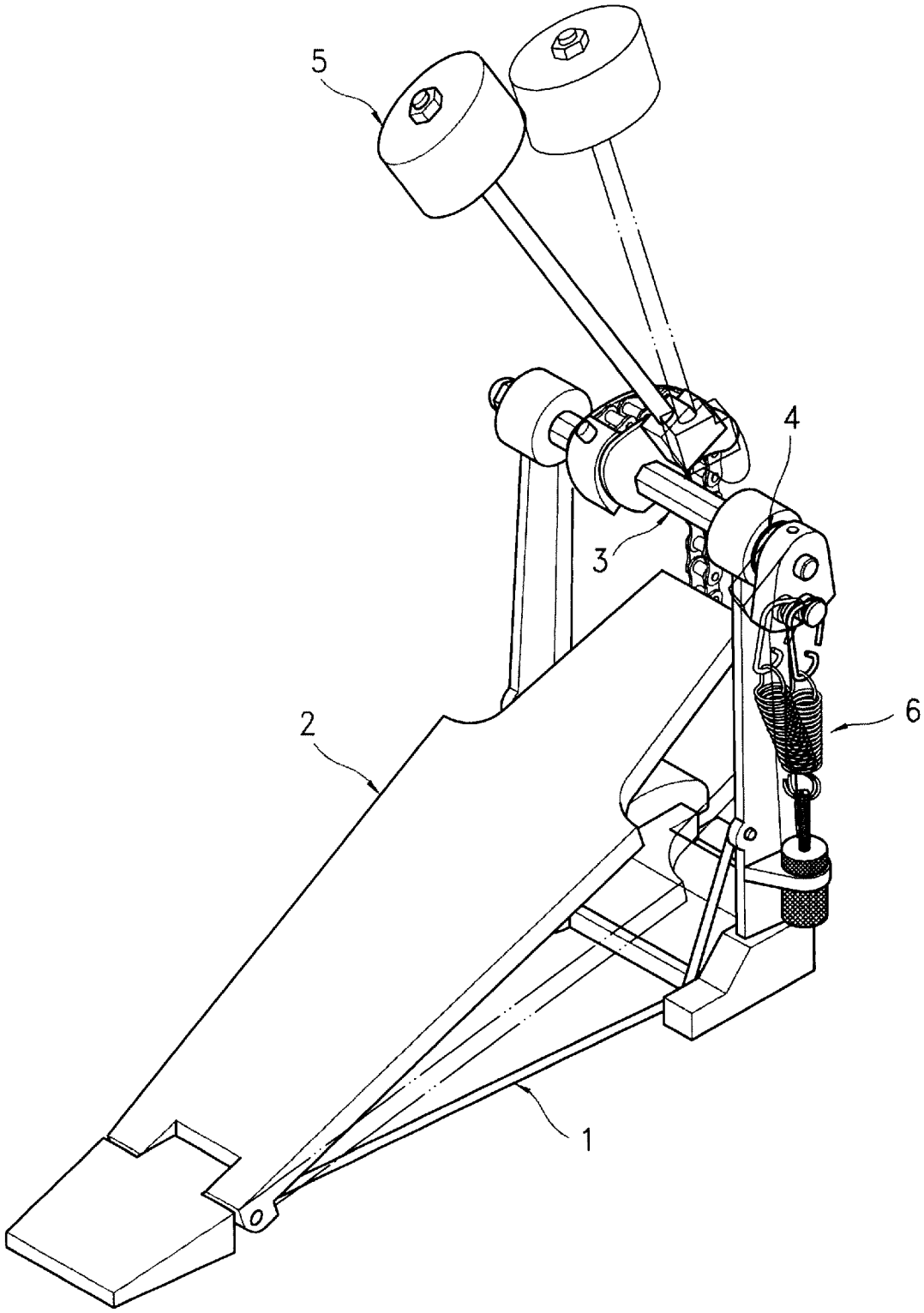
PRIOR ART FIG. 2
FIG. 2 illustrates the working principle of the conventional drum foot pedal.
Figure 3B:
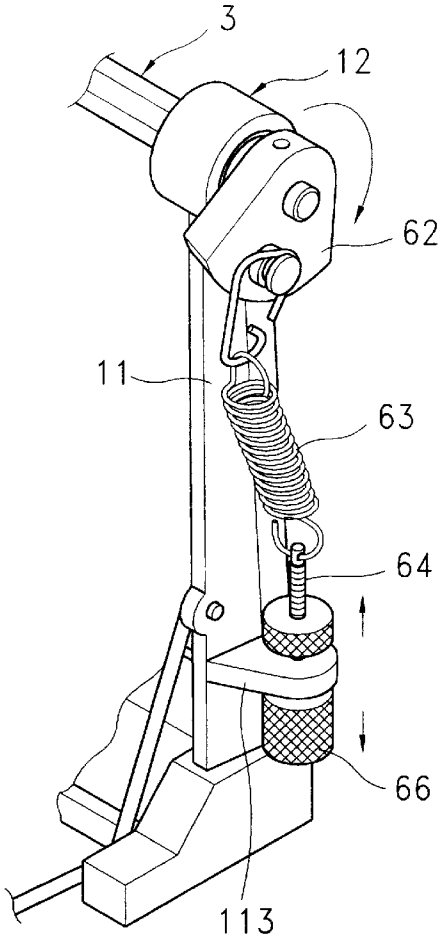
PRIOR ART FIG. 3B
FIGS. 3A and 3B illustrate how the nut is loosened and the spring is distorted in operation.
Figure 3A:
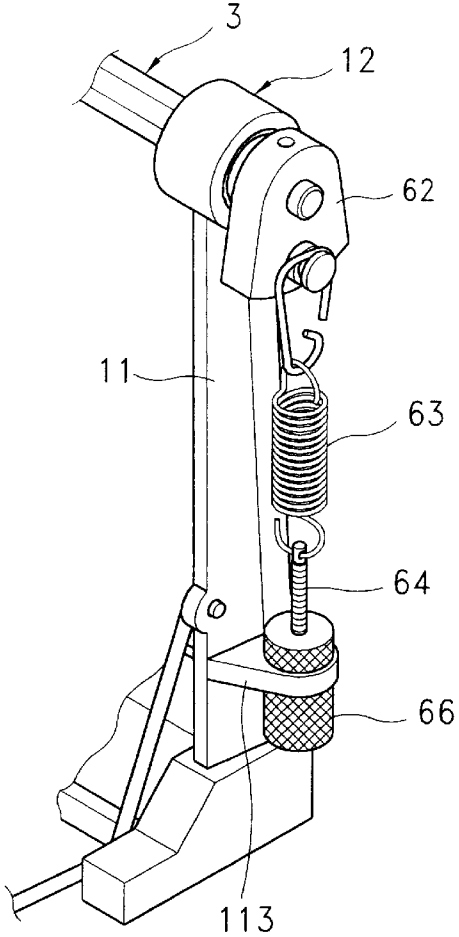
PRIOR ART FIG. 3A

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 4:
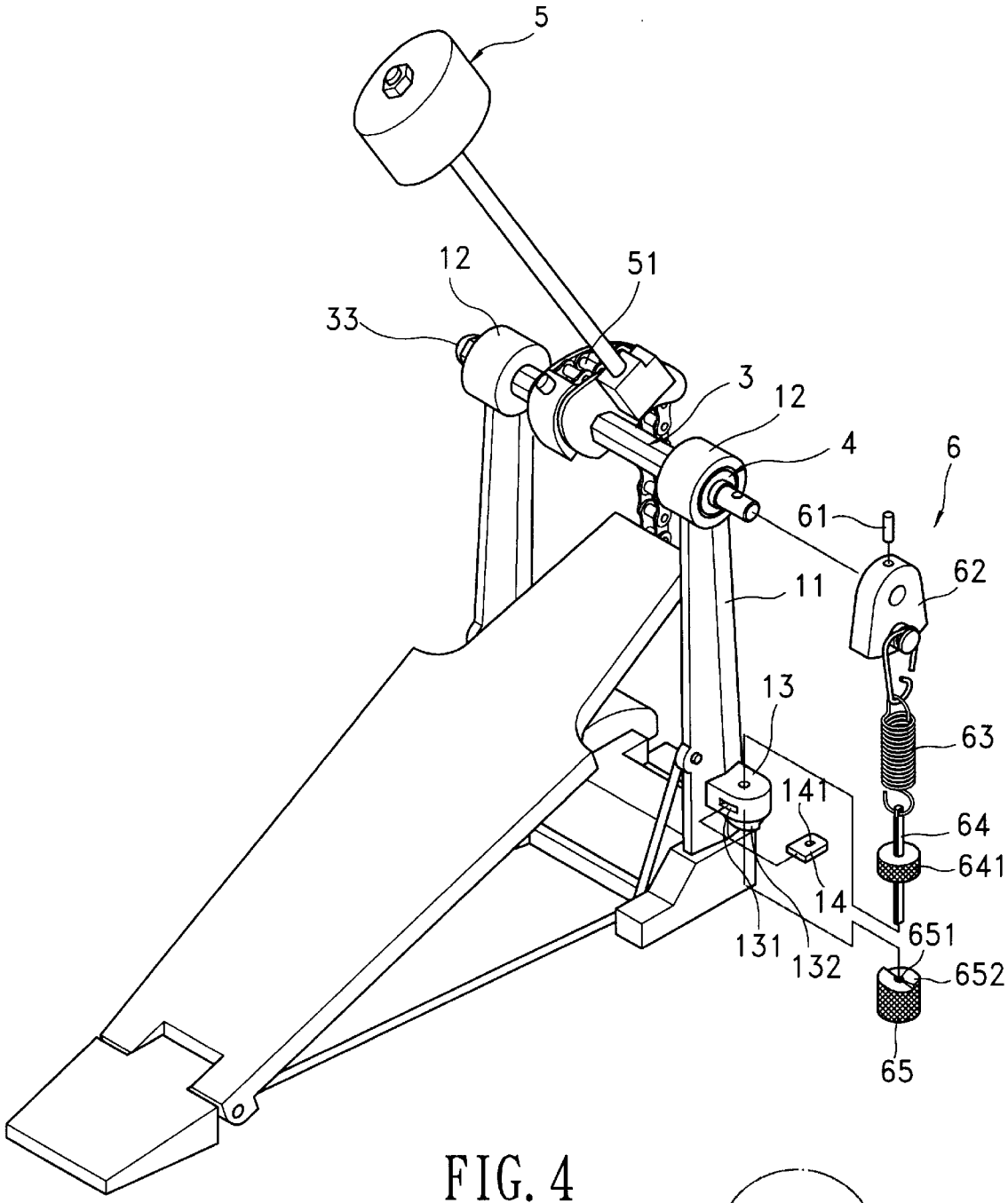
FIGS. 4 and 4A is a perspective view of a drum foot pedal according to the present invention.
Figure 4A:
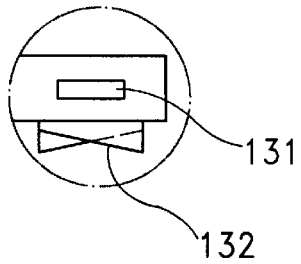
Figure 5:
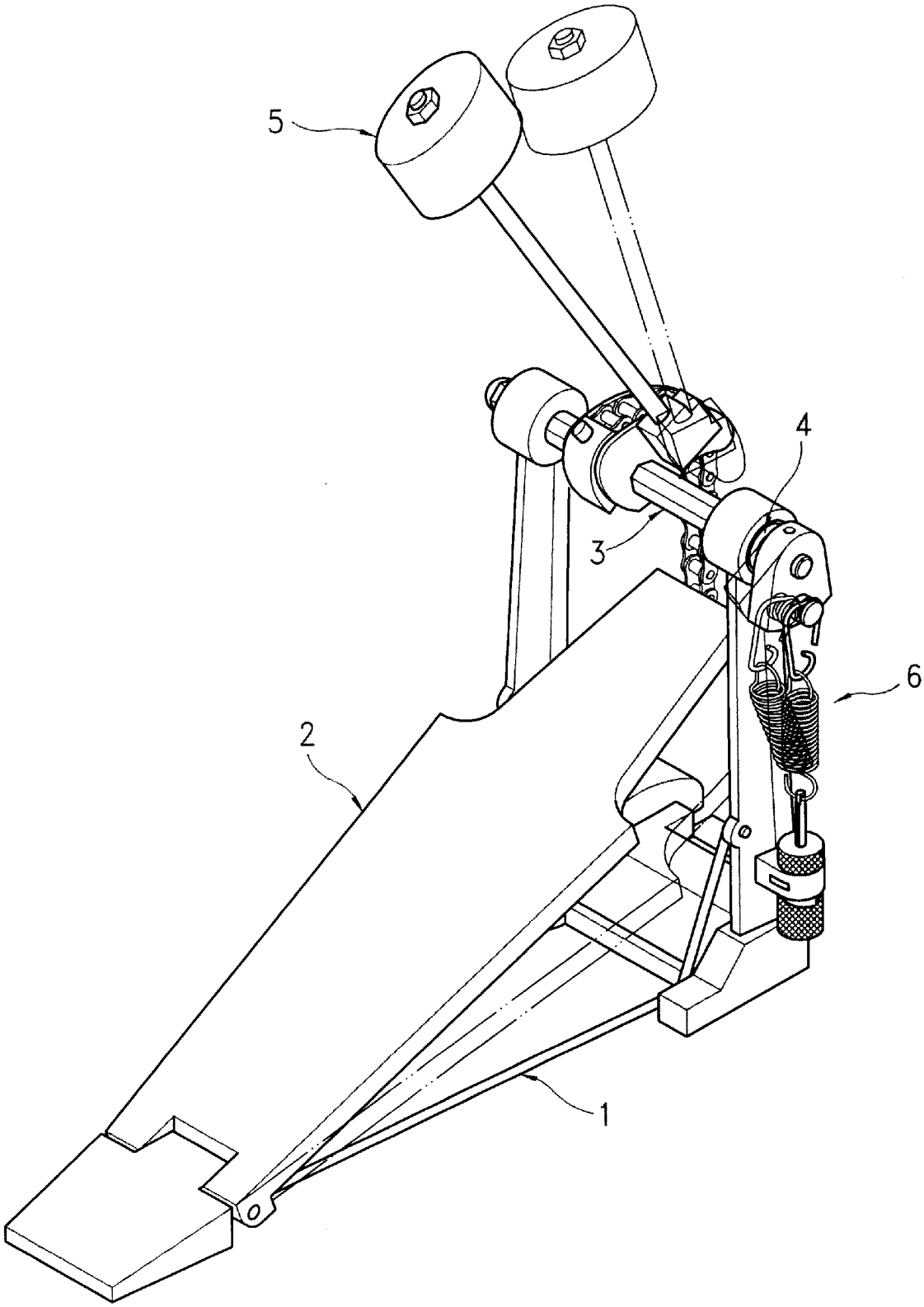
FIG. 5 illustrates the working principle of the present invention.

With reference to the drawings and in particular to FIGS. 4 and 5 thereof, the drum foot pedal according to the present invention generally comprises a base 1, a pedal 2 mounted on the base 1, a hexagonal axle 3, a pair of bearings 4, a stick 5, and a stretching mechanism 6. The stick 5 is fixedly connected at the lower end with the hexagonal axle 3. A block member (shown but not numbered) is fixedly mounted on the hexagonal axle 3 and provided with a chain 51 which extends downwardly therefrom.

The base 1 is provided with two upwardly extending arms 11 each having a sleeve 12 at upper end thereof. The bearing 4 is fitted into the sleeve 12. The outer side of each arm 11 has a positioning flange 13 formed with a slot 131 in which is fitted a positioning plate 14 with a semi-circular hole 141. The bottom of the positioning flange 13 has two cross-inclined surfaces 132.

The pedal 2 is pivotally connected with the base 1 at the lower end and with the chain 51 at the lower end so that the pedal 2 is disposed at an inclined position.

As the stick 5 is fixedly mounted on the hexagonal axle 3, the stick 5 will be rotated in unison with the hexagonal axle 3.

The stretching mechanism 6 includes a connector 62 which is fixedly mounted on the hexagonal axle 3 by a pin 61, a spring 63 having an upper end connected with the connector 62, a screw rod 64 having an upper end connected with the lower end of the spring 62, a nut 641 threadedly engaged with the intermediate portion of the screw rod 64, and a locking nut 65 threadedly engaged with the lower portion of the screw rod 64.

The screw rod 64 is formed with a semi-circular cross section at the intermediate portion thereof adapted to go through the semi-circular hole 141 of the positioning plate 14.

The locking nut 65 has a threaded hole 651 for engaging the screw rod 64 and is formed with two cross inclined surfaces at the upper end engageable with the two cross inclined surfaces 132 of the positioning flange 13.

In assembly, the hexagonal axle 3 extends through the bearings 4 fitted in the sleeves 12 fixedly mounted at the upper ends of the upwardly extending arms 11 of the base 1. Then, the connector 62 is fixedly installed on an end of the hexagonal axle 3 by the pin 61. The other end of the hexagonal axle 3 is engaged with a nut 33 for preventing the hexagonal axle 3 from disengaging from the sleeves 12. The positioning plate 14 is fitted into the slot 131 of the positioning flange 13. The spring 63 is connected at the upper end with the connector 62 and at the lower end with the screw rod 64. The nut 641 is engaged with the intermediate portion of the screw rod 64. The screw rod 41 extends downwardly through the positioning flange 13 and the semi-circular hole 141 of the positioning plate 14 to engage with the locking nut 65, with the two cross inclined surfaces 652 of the locking nut 65 engaged with the two cross inclined surfaces 132 of the positioning flange 13. Accordingly, the screw rod 64 will not be rotated when the spring 63 is stretched and so no clearance will be formed between the nuts 64 and 65 and the positioning flange 13 thereby enabling a user to control the force for beating the drum accurately. In addition, when the spring 63 is stretched, there will be only vertical forces applied on the spring 63 and so no torque will be produced thereby ensuring the smooth operation of the drum foot pedal.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. In a drum foot pedal comprising a base having two upwardly extending arms provided two sleeves at the upper ends thereof, a pedal having an end pivotally mounted on said pedal, a hexagonal axle, two bearings fitted in said sleeves, a stick having an end fixedly mounted on said hexagonal axle, a block member provided with a chain which extends downwardly to engage with another end of said pedal, and a stretching mechanism mounted between an end of said hexagonal axle and a flange of one of said arms, the improvement wherein said stretching mechanism comprises a connector fixedly mounted on said hexagonal axle by a pin, a spring having an upper end connected with said connector, a screw rod having an upper end connected with a lower end of said spring, a nut threadedly engaged with an intermediate portion of said screw rod, and a locking nut threadedly engaged with a lower portion of said screw rod, said flange being formed at the bottom with two cross inclined surfaces and a slot in which is fitted a positioning plate having a semi-circular hole, said screw rod having an intermediate portion formed with a semi-circular cross section configured to engage with said semi-circular hole and said locking nut having two cross inclined surfaces configured to engage with said two cross inclined surfaces of said flange.

* * * * *